US011528969B2

(12) United States Patent
Takasawa

(10) Patent No.: US 11,528,969 B2
(45) Date of Patent: Dec. 20, 2022

(54) TIMEPIECE BAND, EXTERNAL PART FOR A TIMEPIECE, AND TIMEPIECE

(71) Applicant: SEIKO EPSON CORPORATION, Tokyo (JP)

(72) Inventor: Koki Takasawa, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 591 days.

(21) Appl. No.: 16/654,153

(22) Filed: Oct. 16, 2019

(65) Prior Publication Data

US 2020/0121036 A1 Apr. 23, 2020

(30) Foreign Application Priority Data

Oct. 17, 2018 (JP) ..... JP2018-195555

(51) Int. Cl.

| | |
|---|---|
| ***A44C 5/00*** | (2006.01) |
| ***G04B 37/18*** | (2006.01) |
| ***A44C 5/12*** | (2006.01) |
| ***G04B 37/14*** | (2006.01) |

(52) U.S. Cl.

CPC ..... *A44C 5/0061* (2013.01); *A44C 5/12* (2013.01); *G04B 37/14* (2013.01)

(58) Field of Classification Search

CPC ..... A44C 5/0061; A44C 5/12; G04B 37/14

See application file for complete search history.

(56) References Cited

U.S. PATENT DOCUMENTS

| | | | | |
|---|---|---|---|---|
| 2005/0183412 | A1 | 8/2005 | Verdon et al. | |
| 2009/0059735 | A1 * | 3/2009 | Burton | A44C 5/12 368/281 |

FOREIGN PATENT DOCUMENTS

| | | | | |
|---|---|---|---|---|
| EP | 3 252 544 | A1 | 12/2017 | |
| JP | 2001-112518 | A | 4/2001 | |
| JP | 2011-193940 | A | 10/2011 | |
| WO | WO-2015079859 | A1 * | 6/2015 | A44C 5/107 |

* cited by examiner

*Primary Examiner* — Jack W Lavinder
(74) *Attorney, Agent, or Firm* — Oliff PLC

(57) ABSTRACT

Provided is a timepiece band that improves durability, water resistance, and fit. The timepiece band includes a first band, which is a single part, configured from metallic glass with an elastic modulus greater than or equal to 30 GPa and less than or equal to 70 GPa, and an elastic limit greater than or equal to 2% and less than or equal to 20%, and a second band, which is also a single part, configured from metallic glass with an elastic modulus greater than or equal to 30 GPa and less than or equal to 70 GPa, and an elastic limit greater than or equal to 2% and less than or equal to 20%.

20 Claims, 17 Drawing Sheets

TIMEPIECE BAND, EXTERNAL PART FOR A TIMEPIECE, AND TIMEPIECE

BACKGROUND

1. Technical Field

The present invention relates to a timepiece band, an external part for a timepiece, and a timepiece.

The present application claims the priority of Japan Patent Application No. 2018-195555, filed on Oct. 17, 2018, all contents of which are herein incorporated by reference.

2. Related Art

As described in JP A 2011-112518, timepiece bands include metal bands comprising multiple metal link connected together, and leather band and plastic bands as described in JP-A-2011-193940.

Because the metal links of a metal link band do not bend and the band bends only at the connections between the links, gaps can occur between the band and the wrist when the band is worn on the wrist, and improving the fit and feel of the band when worn is difficult.

Because both leather bands and plastic bands curve continuously, the fit can be easily improved compared with a metal link band, but durability and water resistance are inferior to a metal link band, and the feel of a metal band cannot be achieved.

SUMMARY

A timepiece band according to one aspect of the invention is a single part configured from metallic glass with an elastic modulus greater than or equal to 30 GPa and less than or equal to 70 GPa, and an elastic limit greater than or equal to 2% and less than or equal to 20%.

The timepiece band in an aspect of the invention has a base end part attached to the timepiece case, a distal end part that is the opposite end as the base end part, and a middle part between the base end part and the distal end part, and the middle part curves from the base end part to the distal end part.

A timepiece band according to another aspect of the invention includes a first band, which is a single part, configured from metallic glass with an elastic modulus greater than or equal to 30 GPa and less than or equal to 70 GPa, and an elastic limit greater than or equal to 2% and less than or equal to 20%, and a second band, which is also a single part, configured from metallic glass with an elastic modulus greater than or equal to 30 GPa and less than or equal to 70 GPa, and an elastic limit greater than or equal to 2% and less than or equal to 20%.

Preferably, a timepiece band according to another aspect of the invention also has a connection device that connects the first band and the second band.

In a timepiece band according to another aspect of the invention, the first band and the second band each have a base end part attached to the timepiece case, a distal end part that is the opposite end as the base end part, and a middle part between the base end part and the distal end part, and the middle part curves from the base end part to the distal end part.

In a timepiece band according to another aspect of the invention, the first band and the second band each have a base end part attached to the timepiece case, a distal end part that is the opposite end as the base end part, and a middle part between the base end part and the distal end part, and the thickness of the distal end part is greater than the thickness of the middle part.

In a timepiece band according to another aspect of the invention, the metallic glass is preferably metallic glass based on Pt, Au, Ti, Mg, Pd, or Zr.

In a timepiece band according to another aspect of the invention, the hardness of the metallic glass is greater than or equal to 300 HV and less than or equal to 500 HV.

In a timepiece band according to another aspect of the invention, grooves are formed across the width of the timepiece band in at least the front or the back side of the timepiece band.

Another aspect of the invention is an external timepiece part including a timepiece case and a timepiece band integrally formed from metallic glass with an elastic modulus greater than or equal to 30 GPa and less than or equal to 70 GPa, and an elastic limit greater than or equal to 2% and less than or equal to 20%.

The timepiece band of the external timepiece part in another aspect of the invention includes a first band and a second band formed integrally with the timepiece case.

An external timepiece part according to another aspect of the invention also has a connection device that connects the first band and the second band.

In an external timepiece part according to another aspect of the invention, the first band and the second band each have a base end part that is formed contiguously to the timepiece case, a distal end part that is the opposite end as the base end part, and a middle part between the base end part and the distal end part, and the middle part curves from the base end part to the distal end part.

In an external timepiece part according to another aspect of the invention, the first band and the second band each have a base end part that is formed contiguously to the timepiece case, a distal end part that is the opposite end as the base end part, and a middle part between the base end part and the distal end part, and the thickness of the distal end part is greater than the thickness of the middle part.

In an external timepiece part according to another aspect of the invention, the timepiece band is configured as a single band formed integrally with the timepiece case.

In an external timepiece part according to another aspect of the invention, the band has a base end part that is formed contiguously to the timepiece case, a distal end part that is the opposite end as the base end part, and a middle part between the base end part and the distal end part, the middle part curving from the base end part to the distal end part.

In an external timepiece part according to another aspect of the invention, the timepiece case has a ring-shaped case body, and a dial formed integrally with the case body.

In an external timepiece part according to another aspect of the invention, the metallic glass is preferably metallic glass based on Pt, Au, Ti, Mg, Pd, or Zr.

In an external timepiece part according to another aspect of the invention, the hardness of the metallic glass is preferably greater than or equal to 300 HV and less than or equal to 500 HV.

In an external timepiece part according to another aspect of the invention, grooves are formed across the width of the timepiece band in at least the front or the back side of the timepiece band.

Another aspect of the invention is a timepiece including a timepiece case; a first band made that is a single part made from metallic glass with an elastic modulus greater than or equal to 30 GPa and less than or equal to 70 GPa, and an elastic limit greater than or equal to 2% and less than or equal to 20%, and configured to connect to the timepiece case; and a second band that is a single part made from metallic glass with an elastic modulus greater than or equal to 30 GPa and less than or equal to 70 GPa, and an elastic limit greater than or equal to 2% and less than or equal to 20%, and configured to connect to the timepiece case.

A timepiece according to another aspect of the invention has a timepiece case, and a timepiece band that attaches to the timepiece case and is a single part made from metallic glass with an elastic modulus greater than or equal to 30 GPa and less than or equal to 70 GPa, and an elastic limit greater than or equal to 2% and less than or equal to 20%.

A timepiece according to another aspect of the invention has a timepiece case and a timepiece band integrally molded from metallic glass with an elastic modulus greater than or equal to 30 GPa and less than or equal to 70 GPa, and an elastic limit greater than or equal to 2% and less than or equal to 20%.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A timepiece 1 according to the first embodiment of the invention is described next with reference to FIG. 1 and FIG. 2.

Figure 1:
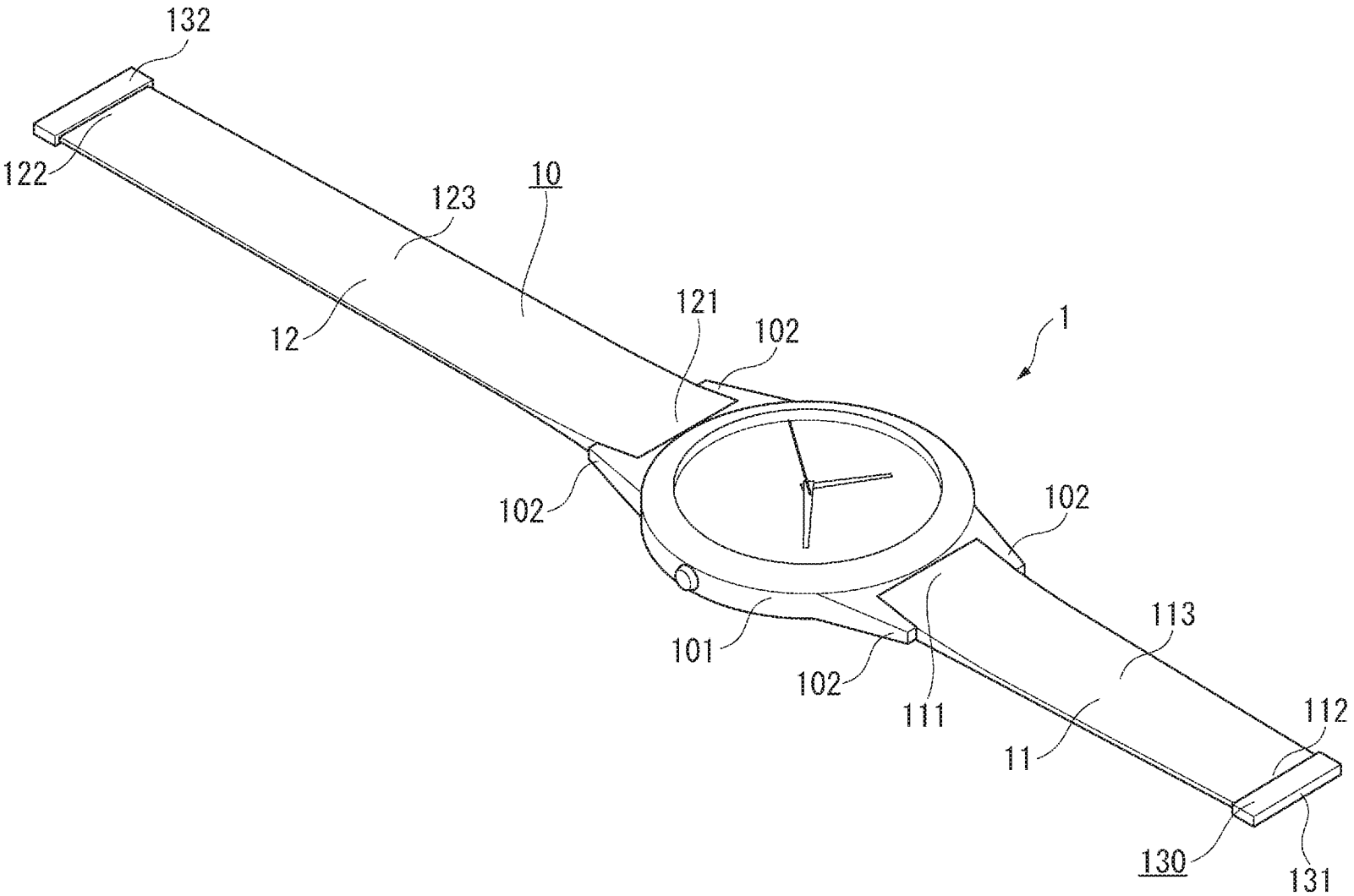
FIG. 1 is an oblique view of a timepiece according to the first embodiment of the invention.
Figure 2:
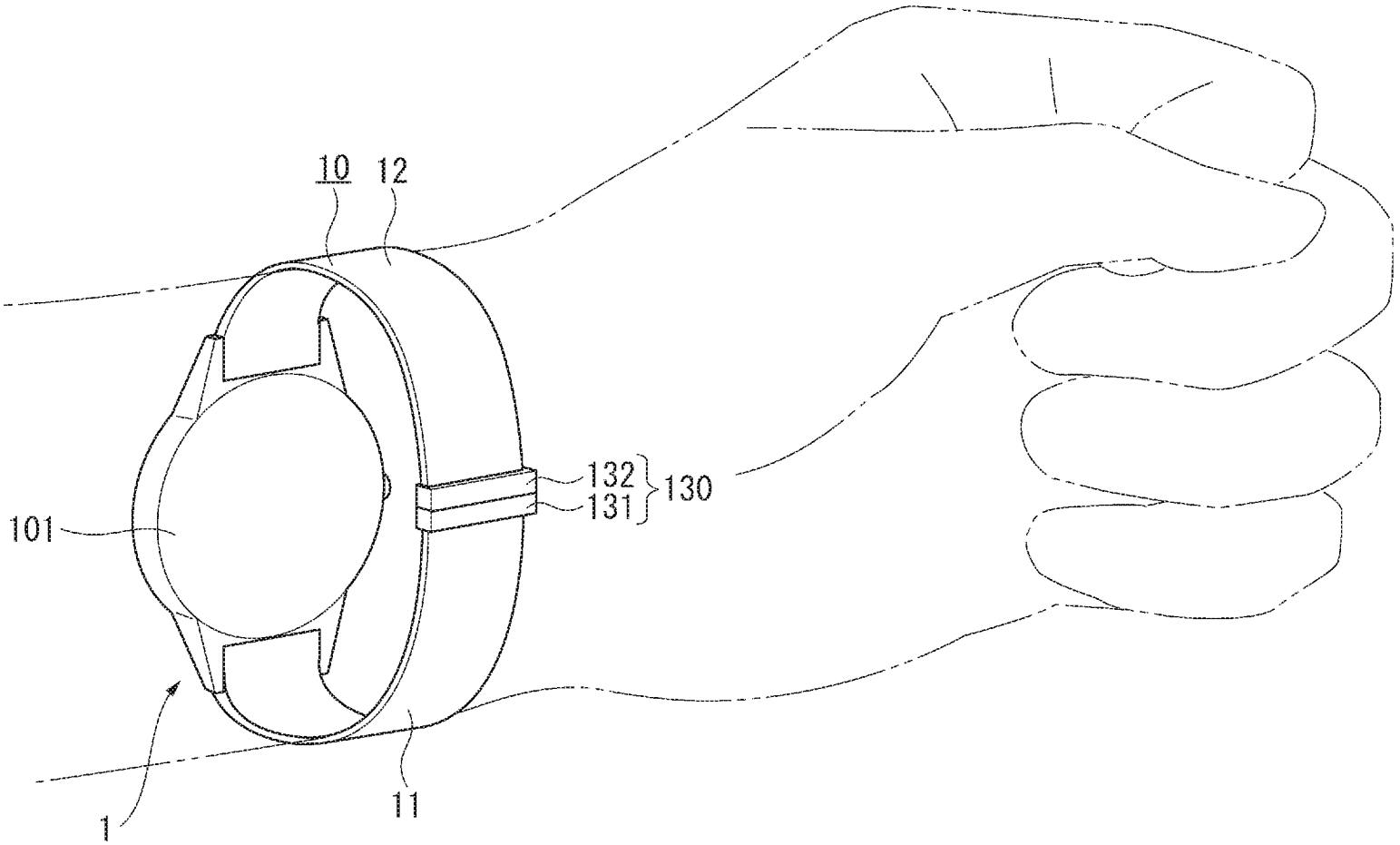
FIG. 2 is an oblique view of a timepiece according to the first embodiment of the invention when worn on the wrist of the user.

As shown in FIG. 1, the timepiece 1 has a timepiece case 101 that holds the movement, and a timepiece band 10 that is attached to the 101. The movement contained in the timepiece case 101 may be a quartz movement including a crystal oscillator, battery, motor, wheel train, and hands, or a mechanical movement including a main spring, escape wheel, escape lever, wheel train, and hands. The timepiece case 101 may also hold a digital display device without hands.

A timepiece case made from materials commonly used for timepieces, including stainless steel, yellow gold, platinum, and titanium, can be used for the timepiece case 101. The timepiece case 101 may also be made from metallic glass similarly to that used for the timepiece band 10 described below.

The timepiece band 10 includes a first band 11 attached to the 12:00 side of the timepiece case 101, and a second band 12 attached to the 6:00 side of the timepiece case 101.

The first band 11 is a single piece made of metallic glass with an elastic modulus greater than or equal to 30 GPa and less than or equal to 70 GPa, and an elastic limit greater than or equal to 2% and less than or equal to 20%. Like the first band 11, the second band 12 is also a single piece made of metallic glass with an elastic modulus greater than or equal to 30 GPa and less than or equal to 70 GPa, and an elastic limit greater than or equal to 2% and less than or equal to 20%.

Note that a single piece or part as used herein means apart configured by a single member, and does not include parts such as metal bands that have multiple metal links connected together. More specifically, the first band 11 and second band 12 are configured as single flat members shaped like a ribbon or strap.

Examples of metallic glass used to configure the first band 11 and second band 12 include metallic glass based on Pt, Au, Ti, Mg, Pd, or Zr may be used as the metallic glass configuring the timepiece case 101. More specifically, a metallic glass composed of $Zr_{55}Al_{10}Ni_5Cu_{30}$, $Mg_{65}Cu_{25}Al_{10}$, $Pt_{60}Cu_{18}P_{22}$, $Au_{65}Cu_{15.5}Ag_{7.5}Si_{17}$, or $Ti_{43}Zr_2Hf_5Cu_{42}Ni_7Si_1$ (at. %) can be used.

Note that the first band 11 and second band 12 are usually configured from metallic glass of the same composition, but the first band 11 and second band 12 may also be made from metallic glass of different compositions.

These metallic glasses have an elastic modulus greater than or equal to 30 GPa and less than or equal to 70 GPa, and an elastic limit greater than or equal to 2% and less than or equal to 20%. Further preferably, the hardness of the metallic glass is within a range greater than or equal to 300 HV and less than or equal to 500 HV. The thickness and width of the first band 11 and second band 12 configuring the timepiece band 10 is set appropriately to the force required when the timepiece 1 is worn on the wrist. For example, if the weight of the timepiece 1 having the movement held in the timepiece case 101 is approximately 150 to 250 g, the thickness and width of the first band 11 and second band 12 are set so that the force holding the timepiece 1 on the wrist is 0.8 to 5.0 kg.

The reasons why the foregoing properties are required for a timepiece band 10 made of metallic glass are described below.

If the elastic modulus is less than 30 GPa, the timepiece band 10 is easily elastically deformed, and the force holding the timepiece case 101 firmly against the wrist drops. As a result, the timepiece 1 may easily separate from the wrist.

If the elastic modulus is greater than 70 GPa, the timepiece band 10 does not easily deform elastically, the timepiece band 10 does not easily conform to the shape of the wrist, and the fit and feel when worn decrease.

However, if the elastic modulus is greater than or equal to 30 GPa and less than or equal to 70 GPa, the timepiece band 10 desirably deforms elastically and feels better when worn while also assuring strength sufficient to secure the timepiece 1.

If the elastic limit is less than 2%, the timepiece case 101 may be damaged by force applied to the timepiece band 10 during use, similarly to when the timepiece band 10 is made from a crystalline metal. In addition, when the timepiece band 10 deforms according to the shape of the wrist, plastic deformation results and the timepiece band 10 may not return to its original shape.

If the elastic limit exceeds 20%, the elastic region increases, and plastic working, including processing by forging and pressing, becomes more difficult. For example, even if compression is applied in the same way as with common crystalline metals, the timepiece band 10 may return to its original shape due to spring back, the processing load increases, and dimensional precision cannot be assured by plastic working.

However, if the elastic limit is greater than or equal to 2% and less than or equal to 20%, the timepiece band 10 is more resistant to damage during use, plastic deformation does not occur, and increasing the load during molding and decreasing dimensional precision can be prevented.

If the hardness is less than 300 HV, the timepiece band 10 is easily scratched during use. If the hardness is greater than 500 HV, surface processing the timepiece case 101 is more difficult, and decoration is more difficult. As a result, decorative elements that can be added to the timepiece band 10 are limited.

However, if the hardness is greater than or equal to 300 HV and less than or equal to 500 HV, the timepiece band 10 is more resistant to scratching, the appearance can be improved, and limitations on decorative elements can be reduced.

If the product holding force of the timepiece band 10 is less than 0.8 kg, the timepiece band 10 cannot sufficiently hold the timepiece 1, and the timepiece 1 may fall off. If the product holding force of the timepiece band 10 is greater than 5.0 kg, deforming the timepiece band 10 to place the timepiece 1 on the wrist is difficult.

However, if the product holding force is greater than or equal to 0.8 kg and less than or equal to 5.0 kg, the timepiece 1 can be prevented from falling off and wearability on the wrist can be improved.

A first band 11 and second band 12 of metallic glass can be formed in a molding process using a mold. Molding processes using a mold may include injection molding, casting, and processing using supercooled liquids. Examples of processing methods using a supercooled liquid include casting, pultrusion, extrusion, and pressing.

Because metallic glass has high transferability, when the single-piece first band 11 and second band 12 are molded, decoration can be simultaneously imparted to the surface of the bands by forming the decorative pattern to be formed on the surface in the mold.

The first band 11 and second band 12 are each formed in a ribbon-like shape, that is, long thin flat members, and each have a base end part 111, 121 that attaches to the timepiece case; a distal end part 112, 122, which is the end at the opposite end as the base end part 111, 121; and a middle part 113, 123 between the base end part 111, 121 and the distal end part 112, 122.

While not shown in the figures, through-holes through which spring pins pass are formed in the base end parts 111, 121. As a result, the first band 11 and second band 12 can be attached by spring pins to the lugs 102 of the timepiece case 101, and can be attached using the same configuration used with metal link bands, leather bands, and plastic bands.

A connector 130 enabling connecting the first band 11 and second band 12 is disposed to the distal end 112, 122 of the first band 11 and second band 12. The connector 130 in this example is a permanent magnet 131, 132 affixed to the distal end 112, 122 of the first band 11 and second band 12. The permanent magnets 131, 132 hold the distal ends 112, 122 together by magnetic force. As shown in FIG. 2, the connector 130 disconnectably connects the first band 11 and second band 12 by the magnetic force of the permanent magnets 131, 132.

Effect of Embodiment 1

Because the first band 11 and second band 12 forming the timepiece band 10 are formed as single pieces each made of metallic glass, the fit and feel can be improved compared with a band made of multiple metal links. More specifically, because a band made of multiple metal links only bends at the connections between the links, a gap easily results between the wrist and the links of the timepiece band, and the fit of the band to the wrist when worn is limited.

However, because the first band 11 and second band 12 of the invention are made from metallic glass with a low elastic modulus of greater than or equal to 30 GPa and less than or equal to 70 GPa in this embodiment of the invention, the first band 11 and second band 12 deform smoothly according to the shape of the wrist when the timepiece 1 is put on the wrist, and the fit and feel can be improved.

In addition, because a band of metal links requires connecting the links together, improving productivity is difficult. However, because the first band 11 and second band 12 in the invention are single pieces, productivity can be easily improved compared with a band assembled from multiple metal links.

Furthermore, because the first band 11 and second band 12 are made from metallic glass, durability and water resistance can be improved compared with leather bands and plastic bands, and a metallic feel can be achieved.

Yet further, because the hardness of metallic glass is greater than crystalline metal alloys, metallic glass is also more resistant to scratching. As a result, scratches can be prevented from degrading the appearance of the timepiece band 10.

For example, while the hardness of a Pt alloy is greater than or equal to 50 HV and less than or equal to 100 HV, the hardness of metallic glass based on Pt is greater than or equal to 400 HV and less than or equal to 500 HV. As a result, the hardness of the first band 11 and second band 12 made of metallic glass can be set to greater than or equal to 300 HV and less than or equal to 500 HV, the elastic limit can be set to greater than or equal to 2%, and a timepiece band 10 with good scratch resistance, improved resistance to damage and plastic deformation during use, and high hardness resistant to damage can be provided.

Because the first band 11 and second band 12 can be manufactured from metallic glass in a molding process, a timepiece band with excellent decoration can be made. More specifically, because metallic glass has excellent transferability, by forming a decorative pattern in the mold, surface decoration can be formed simultaneously to molding the first band 11 and second band 12, and productivity and decorativeness can be improved.

Because metallic glass has a lower melting point than crystalline metal and can be easily manufactured by casting, productivity can also be improved.

Furthermore, because metallic glass has high hardness, the thickness of the first band 11 and second band 12 can be reduced, and the weight of the lightweight timepiece band 10 can be reduced.

Yet further, because metallic glass has low thermal conductivity, the first band 11 and second band 12 do not feel cold when worn on the wrist. As a result, stimulating the sense of cold of the user wearing the timepiece band 10, and feelings of discomfort, can be prevented.

Furthermore, because metallic glass has a large elastic deformation range, it has a smooth feel and is scratch resistant. As a result, scratching of the timepiece band 10 when the timepiece 1 is dropped, for example, can be prevented.

Furthermore, because the solidification shrinkage of metallic glass is low, change of shape during casting is small, and high precision casting is possible.

Furthermore, because metallic glass can be formed in a supercooled liquid state between a low viscosity solid and a liquid, viscoelastic processing is possible. More specifically, because metallic glass can be heated to a supercooled liquid state, high deformation rate processing is possible by heating, and high precision transferability on the nano order can be achieved. As a result, detailed decoration can be imparted to the surface of the first band 11 and second band 12, a high precision finish can be imparted to the first band 11 and second band 12 during the molding process, finishing work can be reduced, and productivity can be greatly improved.

Furthermore, because metallic glass does not have a grain boundary, abradability can be improved when polishing the surface, and undulations caused by a grain boundary can be eliminated.

By manufacturing the first band 11 and second band 12 from a metallic glass having the properties described above, a timepiece band 10 with various characteristics superior to metal link bands, leather bands, and plastic bands can be provided.

Variations of Embodiment 1

Figure 3:
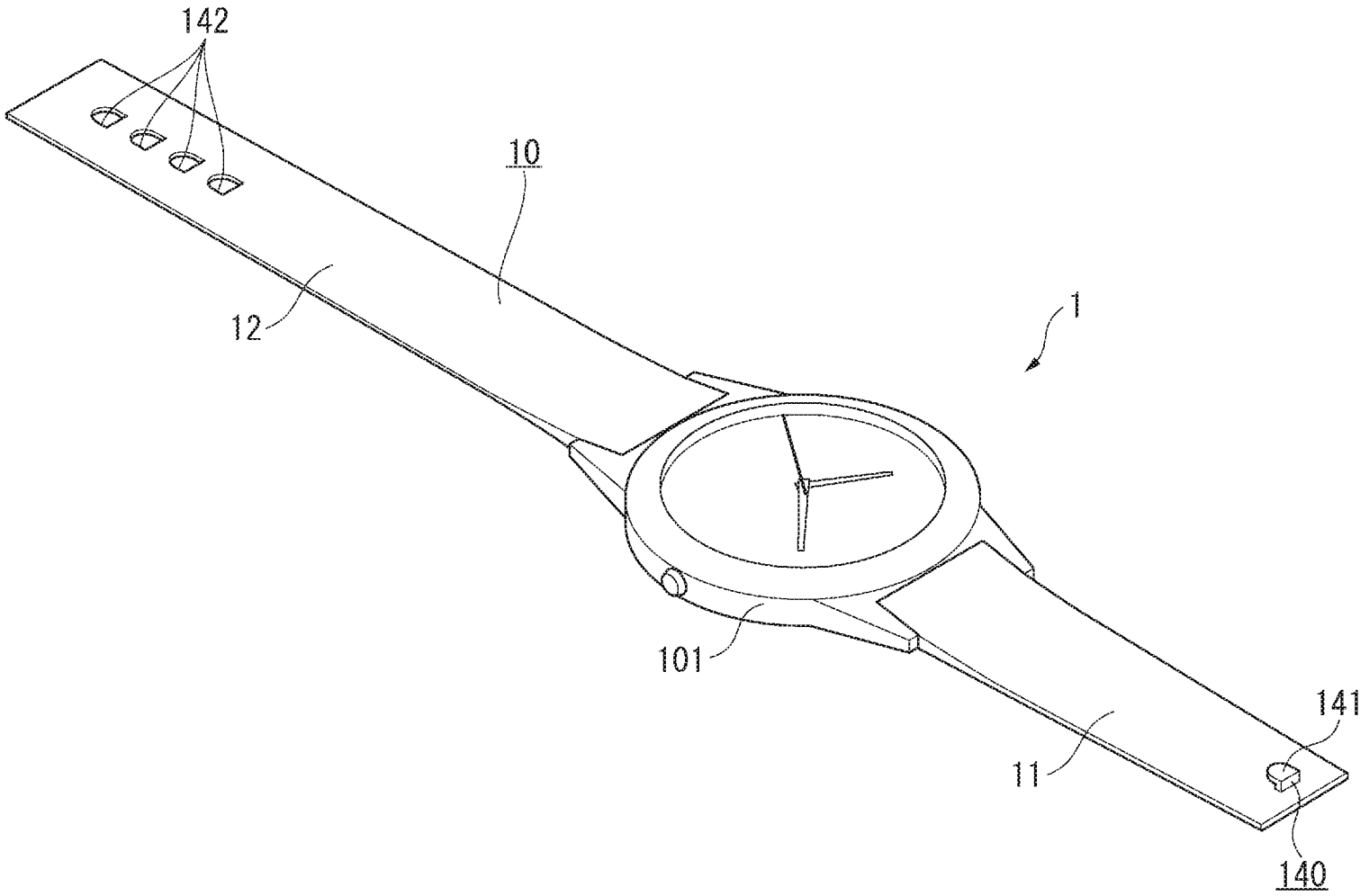
FIG. 3 is an oblique view of a timepiece according to a variation of the first embodiment of the invention.

As shown in FIG. 3, a connector 140 including a protrusion 141 formed at the distal end of the first band 11, and multiple holes 142 that can be engaged by the protrusion 141 and are formed in the second band 12 at multiple places along the length of the second band 12, can also be used as a connector for connecting the first band 11 and second band 12. In this case, the protrusion 141 is engaged with one of the holes 142 to removably connect the first band 11 and second band 12 to each other. By using this type of connector 140, the length of the timepiece band 10 when the first band 11 and second band 12 are connected together can be adjusted to the size of the wrist of the user, and the fit can be further improved.

Further alternatively, instead of providing the timepiece band 10 with a protrusion 141 and holes 142, the connector may be configured with a permanent magnet affixed to the end of one of the pieces of the bands configuring the timepiece band 10, and a ferromagnet (such as a member based on Fe and Co) or another permanent magnet affixed to the surface between the distal end and middle part of the other band. This connector enables disconnectably connecting the first band 11 and second band 12 by attaching the permanent magnet on the one band to the other band by magnetic force. This configuration enables changing the position where the permanent magnet on the one band attaches to the other band, and thereby enables adjusting the length of the timepiece band 10 when the first band 11 and second band 12 are connected together to the size of the wrist of the user, and the fit can therefore be further improved.

Embodiment 2

Figure 4:
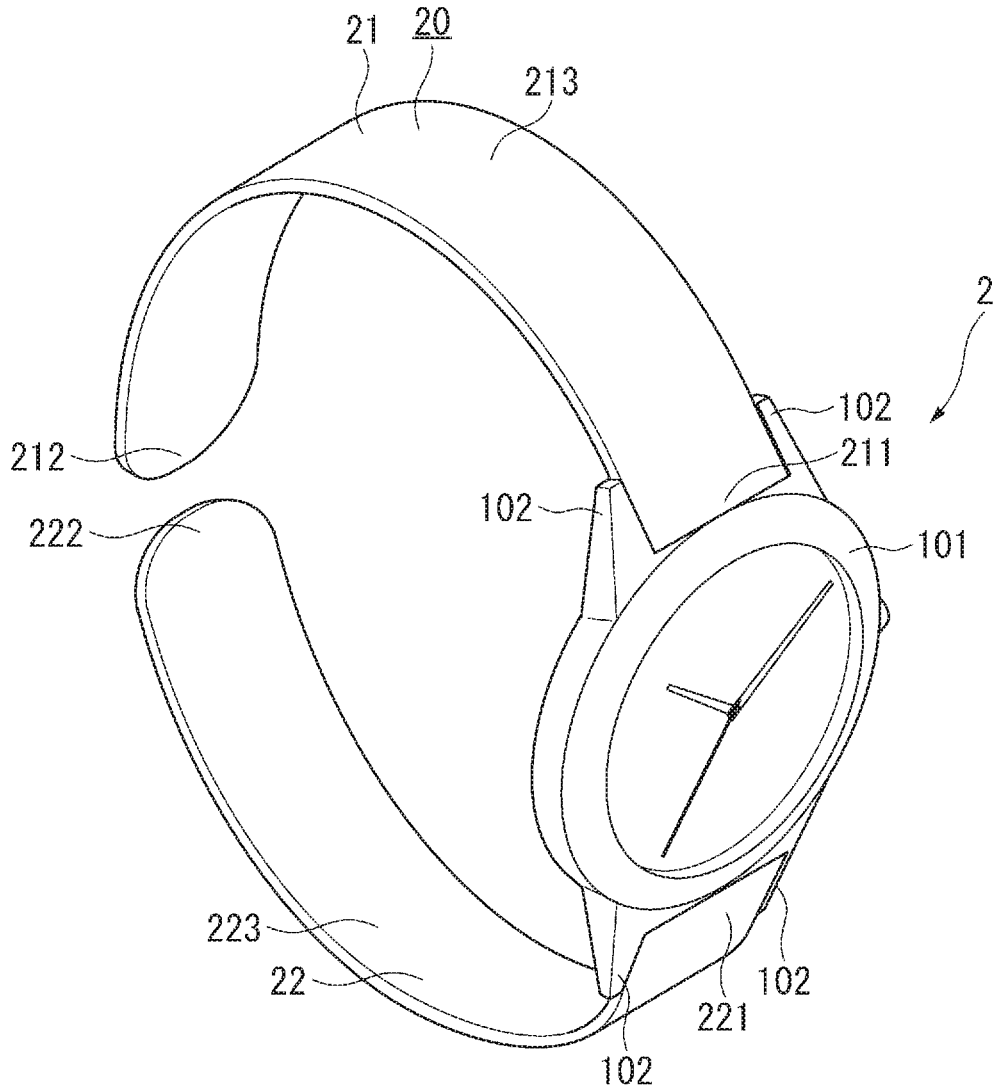
FIG. 4 is an oblique view of a timepiece according to the second embodiment of the invention.

A timepiece 2 according to the second embodiment of the invention is described next with reference to FIG. 4. The timepiece 2 has a timepiece band 20 that attaches to the timepiece case 101.

The timepiece band 20 includes a first band 21 and a second band 22 of which one end each attaches to the lugs 102 of the timepiece case 101. Like the first band 11 and second band 12 of the first embodiment, the first band 21 and second band 22 are made of made of metallic glass with an elastic modulus greater than or equal to 30 GPa and less than or equal to 70 GPa, and an elastic limit greater than or equal to 2% and less than or equal to 20%. Specific examples of the metallic glass are the same as in the first embodiment.

The first band 21 and second band 22 curve along the length of the bands 21 and 22. More specifically, the first band 21 and second band 22 respectively have a base end part 211, 221 that attaches to the timepiece case 101; a distal end part 212, 222, which is the end at the opposite end as the base end part 211, 221; and a middle part 213, 223 between the base end part 211, 221 and the distal end part 212, 222. The middle part 213, 223 curves from the base end part 211, 221 to the distal end part 212, 222.

As a result, the timepiece case 101 and the first band 21 and second band 22 are formed in a substantially C-shaped configuration when seen from the side of the timepiece 2.

The length of the first band 21 and second band 22 is set so that the first band 21 and second band 22 flex and spread, and a gap is formed between the distal end parts 212, 222 when the timepiece band 20 is attached to the wrist W of a user with slender wrists, such as women and children. As a result, when the watch band 20 is put on the wrist W of a user with large wrists, the first band 21 and second band 22 expand further and the gap between the distal end parts 212, 222 increases. When worn, the first band 21 and second band 22 therefore deform elastically according to the shape of the wrist W of the user, the elastic force urging the first band 21 and second band 22 to return to the original shape holds the first band 21 and second band 22 tightly to the wrist W, and the timepiece 2 can be held firmly on the wrist W of the user.

Effect of Embodiment 2

The first band 21 and second band 22 are formed as single pieces each made of metallic glass, and therefore have the same effect as in the first embodiment.

Furthermore, because the first band 21 and second band 22 are formed in a curve, they are worn as though wrapping around the wrist W.

Figure 5:
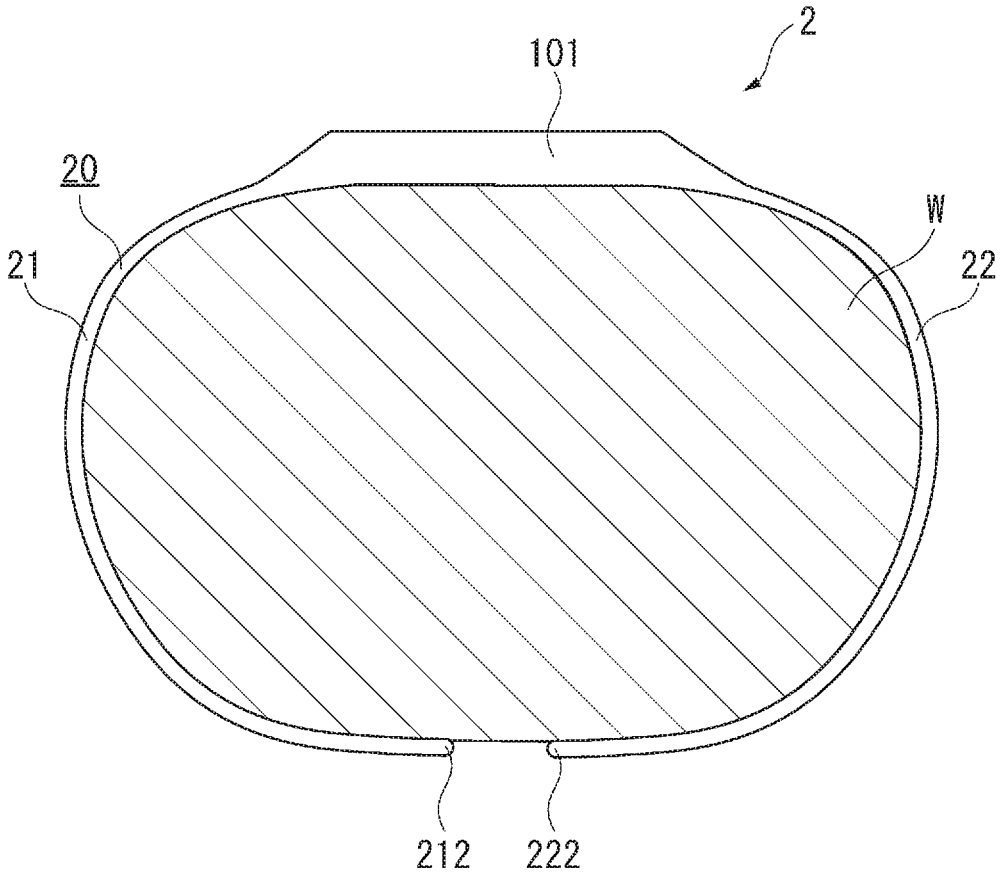
FIG. 5 is a side view of a timepiece according to the second embodiment of the invention.

Because the first band 21 and second band 22 are made from a metallic glass with a lower elastic modulus and higher elastic limit than crystalline metal, the first band 21 and second band 22 curve smoothly along the shape of the wrist W when worn on the wrist W. As a result, as shown in FIG. 5, there is no gap between the first band 21 and second band 22 and the wrist W, and the fit and feel are improved when the timepiece band 20 is attached to the wrist W.

In addition, because the gap between the distal ends 212, 222 of the first band 21 and second band 22 adjusts to the size of the wrist W of the user, differences in the size of the wrist W can be absorbed. As a result, by providing first band 21 and second band 22 of a single length, a freely sizable timepiece band 20 that can be worn comfortably by users with different wrist W sizes can be provided, there is no need to make first bands 21 and second bands 22 of multiple different lengths to accommodate different users, fewer band variations are therefore needed, and cost can be reduced.

Embodiment 3

Figure 6:
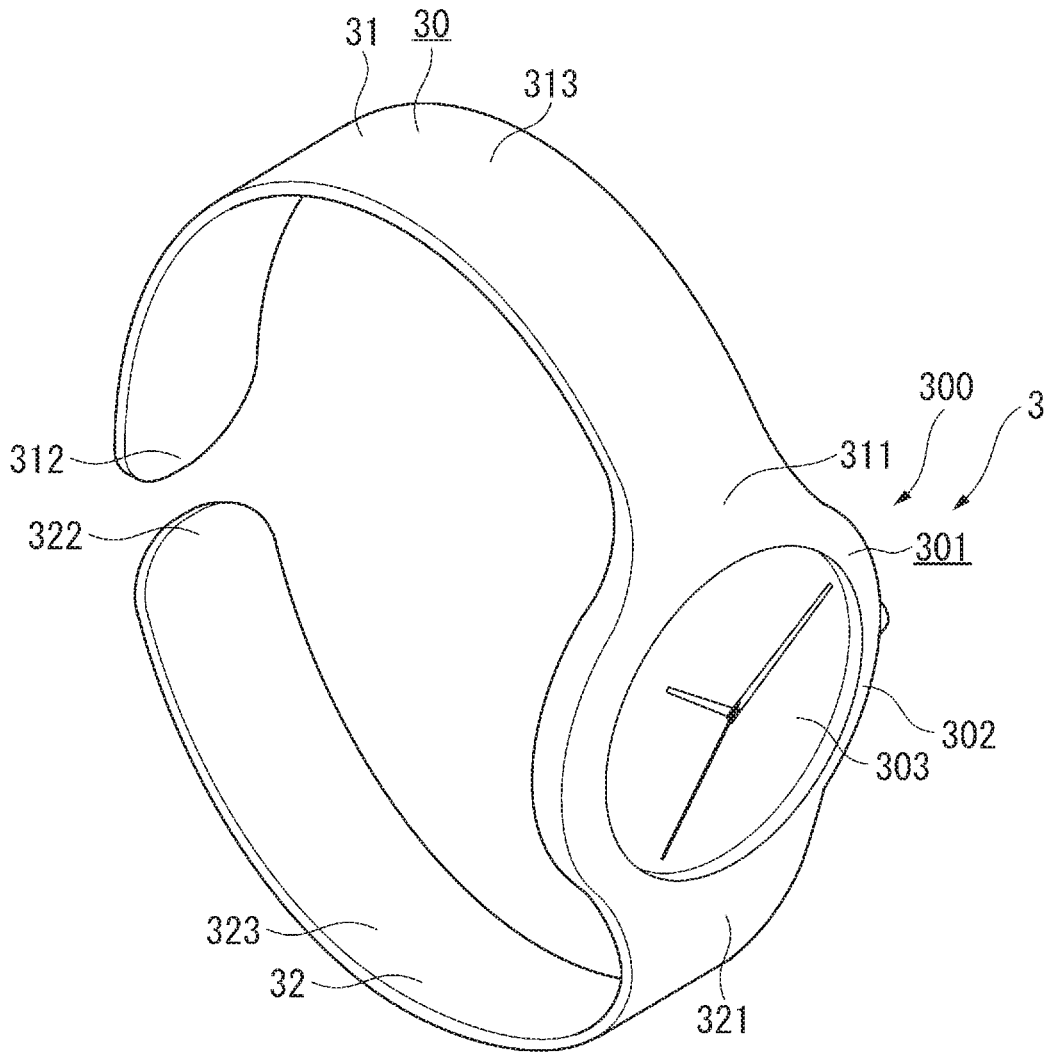
FIG. 6 is an oblique view of a timepiece according to the third embodiment of the invention.

A timepiece 3 according to the third embodiment of the invention is described next with reference to FIG. 6 to FIG. 8. The timepiece 3 has an external timepiece part 300 including a timepiece case 301 and a timepiece band 30.

The external timepiece part 300 is configured as a single member made of metallic glass having an elastic modulus greater than or equal to 30 GPa and less than or equal to 70 GPa, and an elastic limit greater than or equal to 2% and less than or equal to 20%. Specific examples of the metallic glass are the same as the timepiece bands 10, 20 described in the foregoing embodiments.

The timepiece case 301 in this example has a substantially round case body 302, and a dial 303 formed integrally to the inside of the case body 302. The timepiece band 30 includes a first band 31 formed contiguously to the 12:00 side of the timepiece case 301, and a second band 32 formed contiguously to the 6:00 side of the timepiece case 301. The external timepiece part 300 therefore comprises a case body 302, a dial 303, a first band 31, and a second band 32 integrally formed from a metallic glass.

Figure 7:
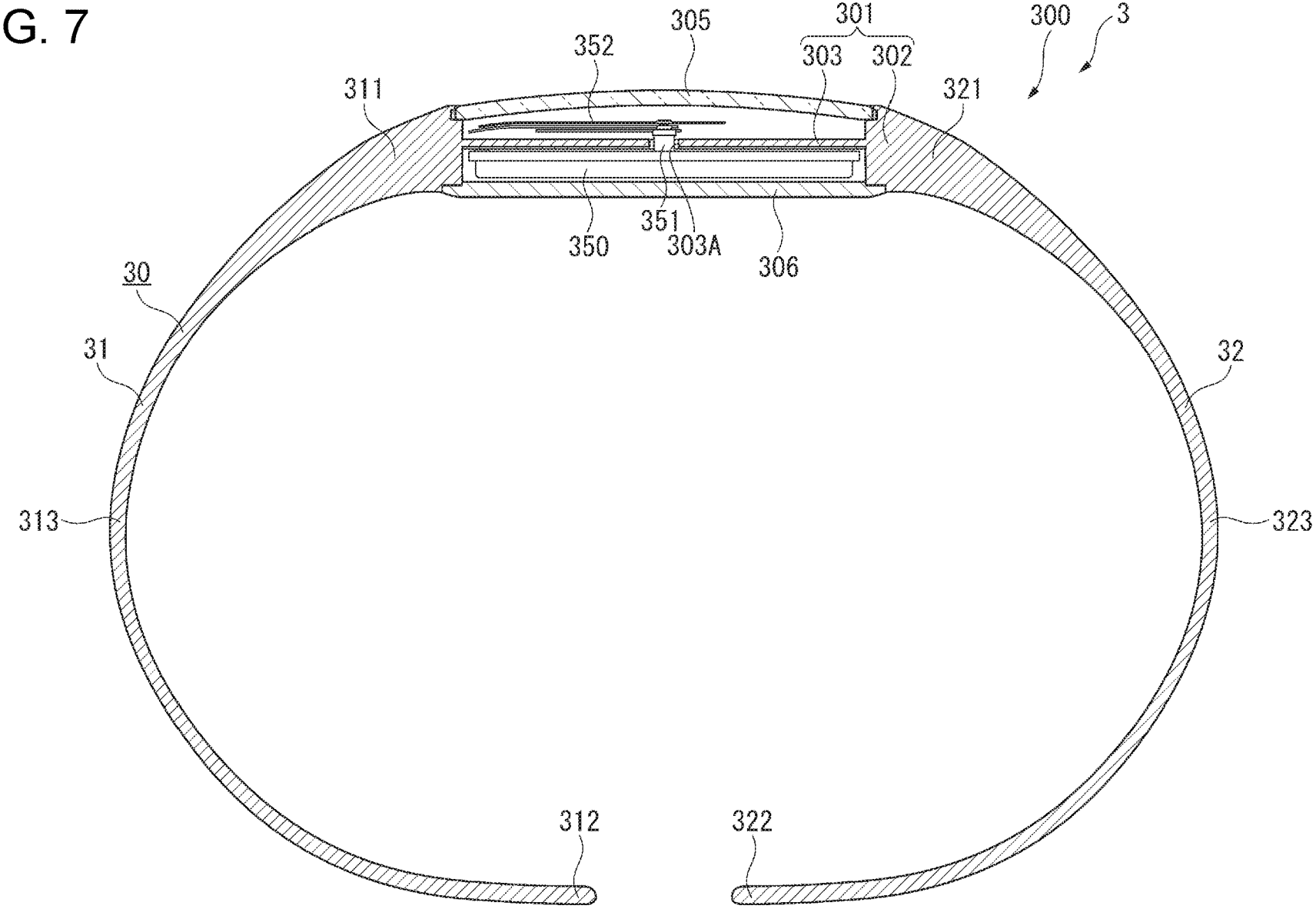
FIG. 7 is a section view of a timepiece according to the third embodiment of the invention.
Figure 8:
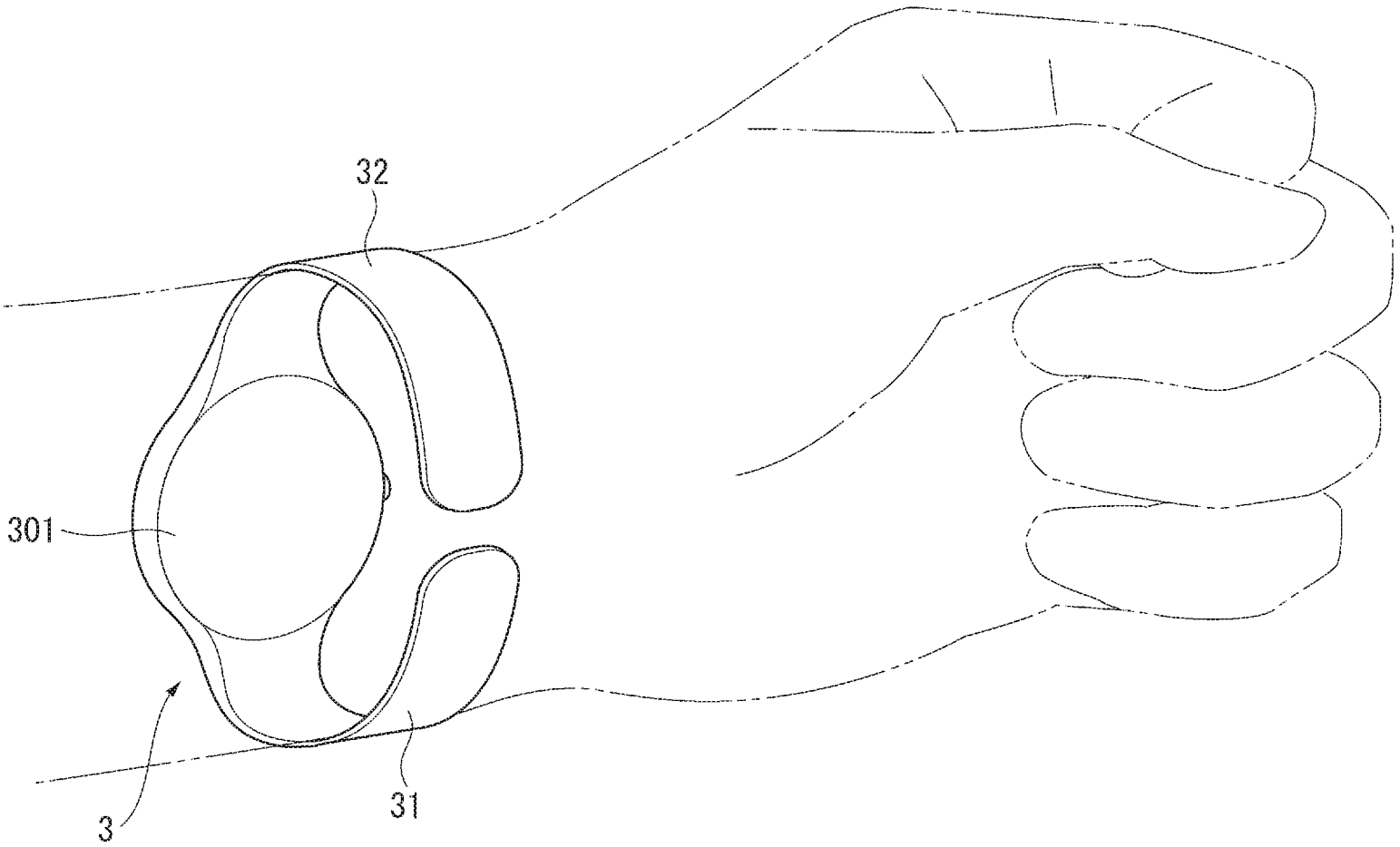
FIG. 8 is an oblique view of a timepiece according to the third embodiment of the invention when worn on the wrist.

As shown in FIG. 7, a crystal 305 is attached to the opening on the face side of the case body 302 of the timepiece case 301, and a back cover 306 is attached to the opening on the opposite side of the case body 302. A through-hole 303A through which the center arbor 351 of the movement 350 passes is formed in the dial 303. In addition, time markers, logos, scales and other elements of the dial can be formed integrally to the dial 303.

The space inside the timepiece case 301 is segmented into two spaces by the dial 303 formed integrally to the case body 302.

To assemble the timepiece 3, the movement 350 is placed inside the timepiece case 301 from the back cover side of the timepiece case 301, and the center arbor 351 is inserted to the through-hole 303A. Hands 352 such as the hour hand, minute hand, and secondhand are then attached to the center arbor 351 exposed to the face side of the dial 303. The crystal 305 and back cover 306 are then attached to the case body 302 of the timepiece case 301 to complete the timepiece 3.

The first band 31 and second band 32 formed integrally to the timepiece case 301 respectively have abase end part 311, 321 that is formed contiguously to the timepiece case 301; a distal end part 312, 322, which is the end at the opposite end as the base end part 311, 321; and a middle part 313, 323 between the base end part 311, 321 and the distal end part 312, 322. The middle part 313, 323 curves from the base end part 311, 321 to the distal end part 312, 322 as with the timepiece band 20 of the second embodiment.

As a result, the timepiece case 301 and the first band 31 and second band 32 are formed, like the timepiece band 20 described above, in a substantially C-shaped configuration when seen from the side of the timepiece 3. As a result, when the timepiece 3 is worn on the user's wrist as shown in 8, the first band 31 and second band 32 deform elastically and bend according to the shape of the user's wrist, the first band 31 and second band 32 are held tight to the wrist, and the timepiece 3 is worn firmly against the wrist.

Effect of Embodiment 3

The first band 31 and second band 32 of the timepiece band 30 have the same configuration as the timepiece band 20 in the second embodiment, and therefore have the same effect as in the second embodiment.

In addition, because the first band 31 and second band 32 configuring the timepiece band 30, the case body 302, and the dial 303 are integrally molded from metallic glass, the strength and appearance of the external timepiece part 300 can be improved.

More specifically, when the timepiece case 101 and timepiece band 20 are configured as discrete members as in the timepiece 2 in the second embodiment, the spring pins may separate from the lugs 102 and deformation may occur when strong force is applied to a connection between the timepiece case 101 and the timepiece band 20.

However, because the timepiece case 301, first band 31, and second band 32 are formed as a single piece in the timepiece 3 according to the third embodiment of the invention, when even a strong force is applied to a connection between the timepiece case 301 and first band 31 or second band 32, the force will be distributed throughout the entire external timepiece part 300. In addition, because the dial 303 is integrally molded with the case body 302, the dial 303 also functions as a reinforcing member that suppresses deformation of the case body 302, and the strength of the timepiece case 301 can be improved compared with a common round, ring-shaped timepiece case. The strength of the external timepiece part 300 can therefore be greatly improved.

Because the timepiece case 301, dial 303, and timepiece band 30 are configured from the same metallic glass, the uniformity of the appearance of the timepiece 3 can be increased, and a sense of luxury can be improved.

Furthermore, because the timepiece case 301 and timepiece band 30 are integrally molded, there are few limitations on the structure of the connection between the timepiece case 301 and timepiece band 30, and the design can be improved. For example, when the timepiece case and timepiece band are connected by a spring pin, lugs 102 must be formed on the timepiece case, and the structure and shape of the connection is limited.

However, if the timepiece case 301 and timepiece band 30 are a single molding, such limitations are reduced, a connection with an outstanding design can be used, and the appearance of the timepiece 3 can be improved.

Embodiment 4

Figure 9:
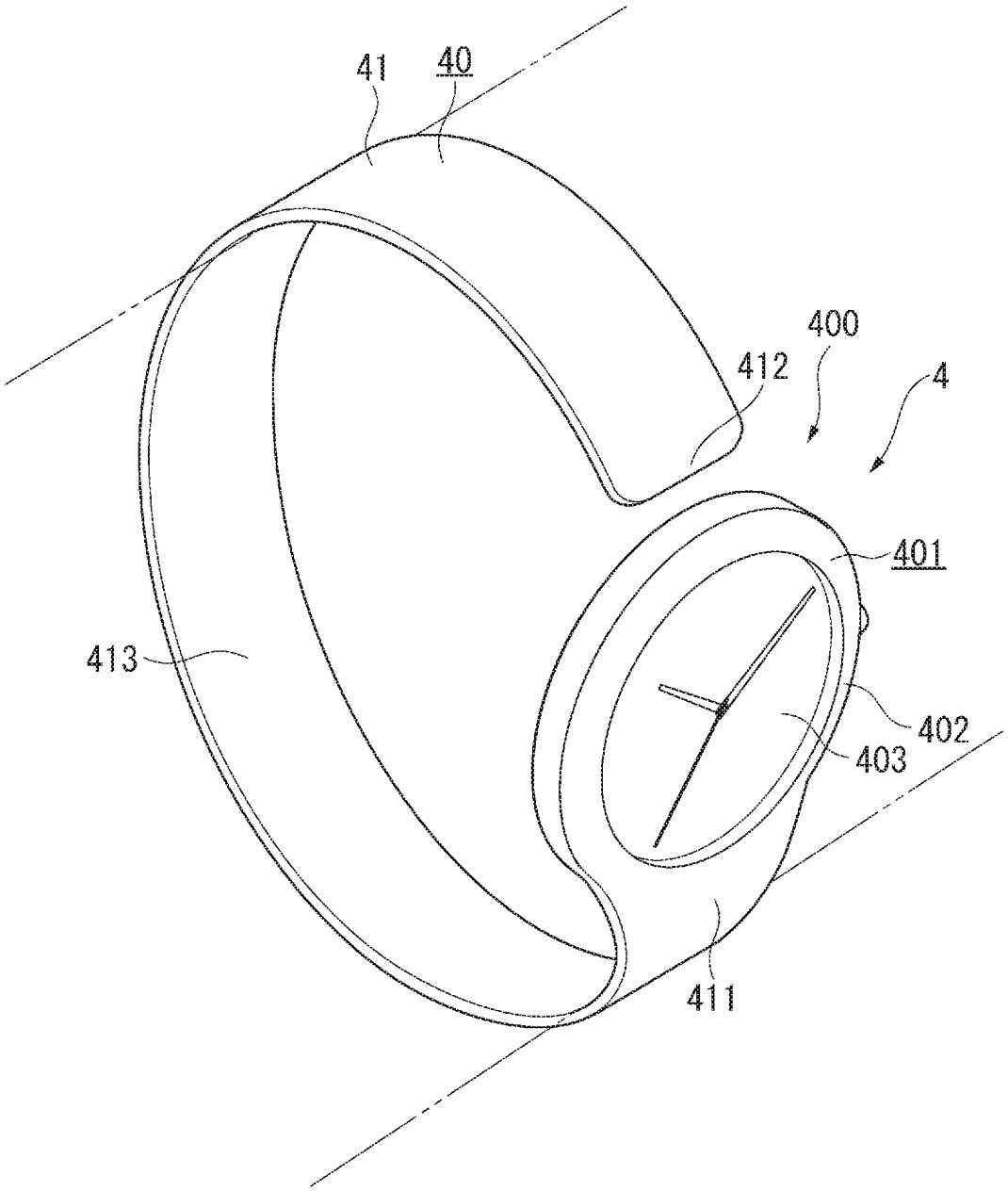
FIG. 9 is an oblique view of a timepiece according to the fourth embodiment of the invention.

A timepiece 4 according to the fourth embodiment of the invention is described next with reference to FIG. 9. The timepiece 4 has an external timepiece part 400 including a timepiece case 401 and a timepiece band 40.

The external timepiece part 400 is configured as a single member made of metallic glass having an elastic modulus greater than or equal to 30 GPa and less than or equal to 70 GPa, and an elastic limit greater than or equal to 2% and less than or equal to 20%. Specific examples of the metallic glass are the same as described in the foregoing embodiments.

The timepiece case 401 in this example has a substantially round case body 402. In this embodiment the dial 403 is formed separately from the case body 402, but the dial 403 and case body 402 may be integrally molded as in the third embodiment.

In this embodiment the timepiece band 40 is configured as a single band 41 formed contiguously from the 6:00 side of the timepiece case 401. The case body 402 and band 41 of the external timepiece part 400 are therefore integrally molded from metallic glass.

The band 41 includes a base end part 411 contiguous to the timepiece case 401, a distal end part 412 at the opposite end as the base end part 411, and a middle part 413 between the base end part 411 and distal end part 412. Similarly to the timepiece bands 20, 30 in the second and third embodiments, the middle part 413 is formed in a curve from the base end part 411 to the distal end part 412.

The distal end part 412 of the band 41 extends to a position near the 12:00 side of the timepiece case 401, and is separated from the timepiece case 401. As a result, the timepiece case 401 and band 41, when seen from the side of the timepiece 4, are substantially C-shaped.

The length of the band 41 is set so that a gap is formed between the distal end part 412 of the band 41 and the timepiece case 401 when the timepiece band 40 is worn by a user with slender wrists, such as women or children. As a result, when the watchband 40 is worn by a user with large wrists, the gap between the distal end part 412 of the band 41 and the timepiece case 401 increases.

Effect of Embodiment 4

Because the timepiece case 401 and band 41 are integrally molded from metallic glass, the same effect as in the second and third embodiments is achieved.

Furthermore, because the band 41 is formed in a curve, the band 41 can wrap around the wrist similarly to the timepiece bands 20, 30 in the second and third embodiments.

Because the band 41 made from a metallic glass with a lower elastic modulus and higher elastic limit than crystalline metal, the band 41 curves smoothly according to the shape of the wrist when worn on the wrist. As a result, there is no gap between the band 41 and the wrist, and the timepiece band 40 can be held firmly against the wrist. The fit and feel of the timepiece band 40 can therefore also be improved.

In addition, because the gap between the distal end of the band 41 and the timepiece case 401 adjusts to the size of the wrist W of the user, differences in the size of the wrist can be absorbed.

As a result, a freely sizable timepiece band 40 that can be worn comfortably by users with different wrist sizes can be provided, and there is no need to make external timepiece parts 400 with bands 41 of multiple different lengths, and cost can be reduced.

Furthermore, because the timepiece band 40 is configured with only a single band 41, and there is no need to connect the timepiece band 40 to the 12:00 side of the timepiece case 401, there are few limitations on the design of the timepiece case 401, and the appearance of the timepiece 4 can be improved.

Variation of Embodiment 4

The external timepiece part 400 is described above with the band 41 connected to the 6:00 side of the timepiece case 401, but the band 41 may obviously be connected to the 12:00 side, for example.

Embodiment 5

Figure 10:
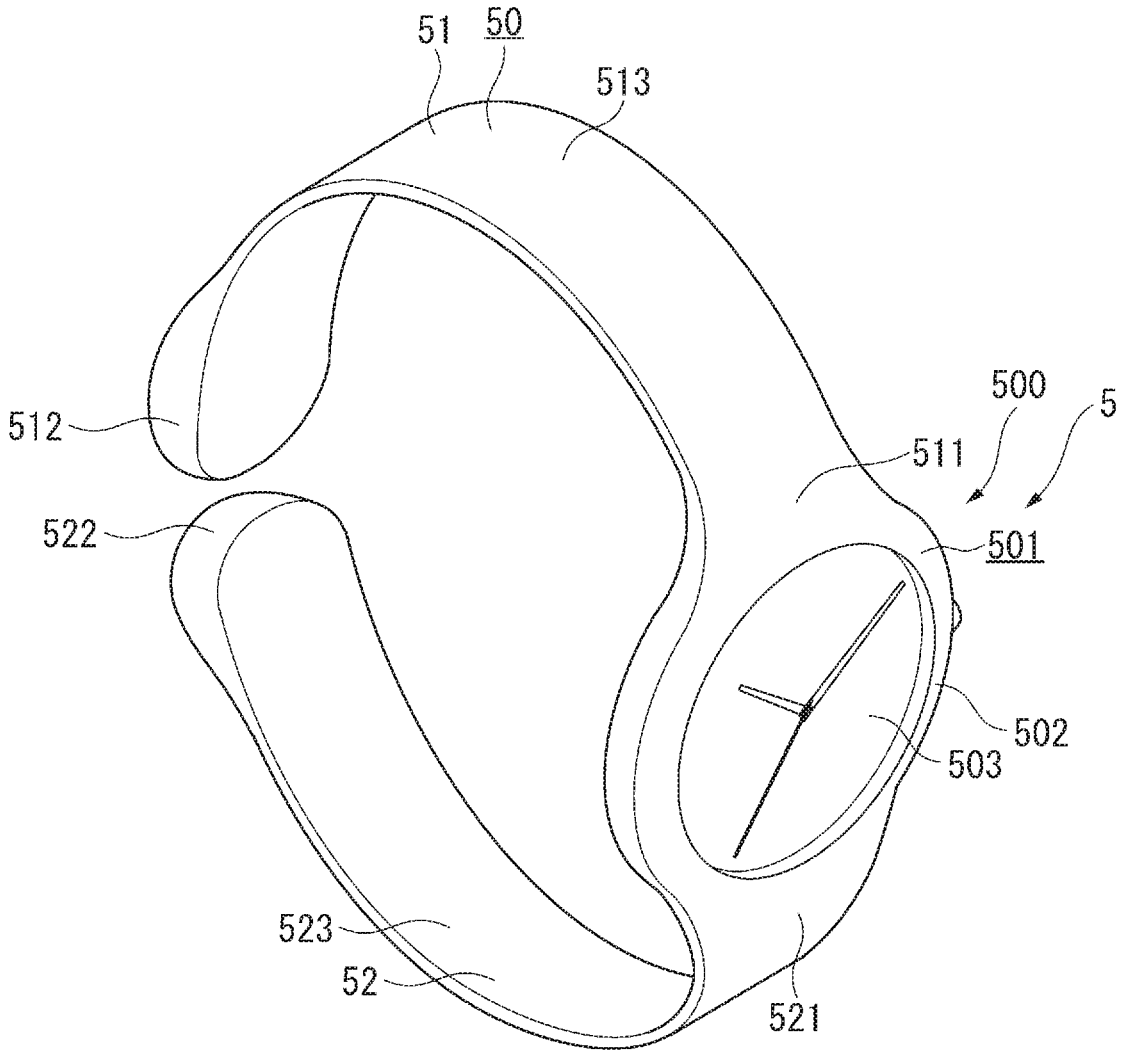
FIG. 10 is an oblique view of a timepiece according to the fifth embodiment of the invention.

A timepiece 5 according to the fifth embodiment of the invention is described next with reference to FIG. 10. The timepiece 5 has an external timepiece part 500 including an integrally molded timepiece case 501 and timepiece band 50.

The external timepiece part 500 is configured as a single member made of metallic glass having an elastic modulus greater than or equal to 30 GPa and less than or equal to 70 GPa, and an elastic limit greater than or equal to 2% and less than or equal to 20%. Specific examples of the metallic glass are the same as described in the foregoing embodiments.

The timepiece case 501 in this example has a substantially round case body 502. In this embodiment the dial 503 is formed separately from the case body 502, but the dial 503 and case body 502 may be integrally molded as in the third embodiment.

In this embodiment the timepiece band 50 includes a first band 51 formed contiguously from the 12:00 side of the timepiece case 501, and a second band 52 formed contiguously from the 6:00 side of the timepiece case 501. The case body 502, first band 51, and second band 52 of the external timepiece part 500 are therefore formed as an integral molding of metallic glass.

The first band 51 and second band 52 respectively have a base end part 511, 521 formed contiguously to the timepiece case 501; a distal end part 512, 522, which is the end at the opposite end as the base end part 511, 521; and a middle part 513, 523 between the base end part 511, 521 and the distal end part 512, 522. The middle part 513, 523 curves from the base end part 511, 521 to the distal end part 512, 522 as with the timepiece band 30 in the third embodiment.

The thickness of the distal end parts 512, 522 of the first band 51 and second band 52 is greater than the thickness of the middle parts 513, 523.

Effect of Embodiment 5

The first band 51 and second band 52 of the timepiece band 50 have the same configuration as the timepiece band 30 in the third embodiment, and therefore have the same effect as in the third embodiment.

In addition, because the distal end parts 512, 522 of the first band 51 and second band 52 are thicker than the other parts, the difference in the weight of the timepiece case 501 housing the movement inside, and the weight of the distal end parts 512, 522 of the first band 51 and second band 52, is less than with the timepiece band 30 of the third embodiment. As a result, the sense of stability when the timepiece 5 is worn on the wrist can be improved.

Embodiment 6

Figure 11:
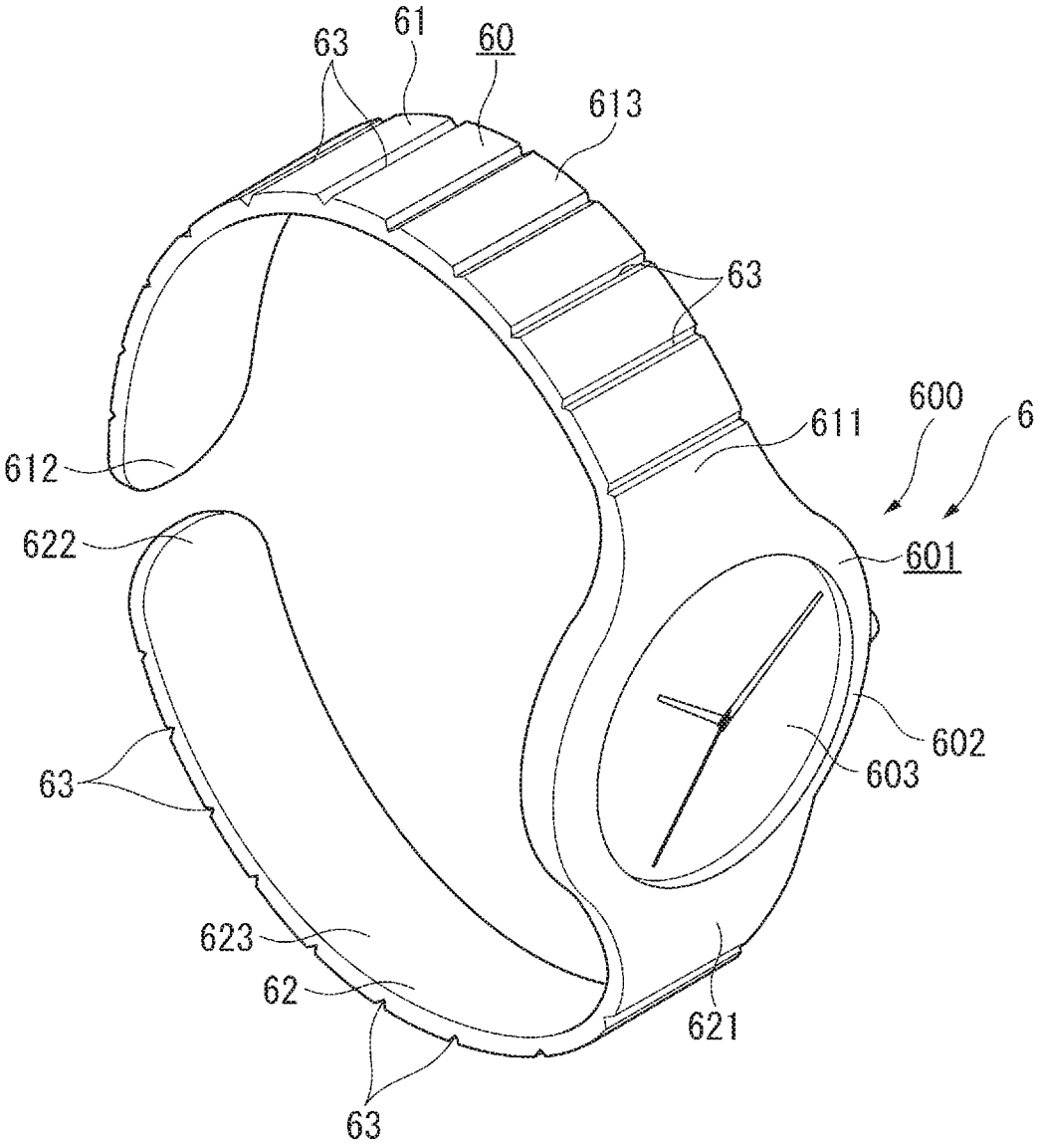
FIG. 11 is an oblique view of a timepiece according to the sixth embodiment of the invention.

A timepiece 6 according to the sixth embodiment of the invention is described next with reference to FIG. 11. The timepiece 6 has an external timepiece part 600 including an integrally molded timepiece case 601 and timepiece band 60.

The external timepiece part 600 is configured as a single member made of metallic glass having an elastic modulus greater than or equal to 30 GPa and less than or equal to 70 GPa, and an elastic limit greater than or equal to 2% and less than or equal to 20%. Specific examples of the metallic glass are the same as described in the foregoing embodiments.

The timepiece case 601 in this example has a substantially round case body 602. In this embodiment the dial 603 is formed separately from the case body 602, but the dial 603 and case body 602 may be integrally molded as in the third embodiment.

In this embodiment the timepiece band 60 includes a first band 61 formed contiguously from the 12:00 side of the timepiece case 601, and a second band 62 formed contiguously from the 6:00 side of the timepiece case 601. The case body 602, first band 61, and second band 62 of the external timepiece part 600 are therefore formed as an integral molding of metallic glass.

The first band 61 and second band 62 respectively have a base end part 611, 621 formed contiguously to the timepiece case 601; a distal end part 612, 622, which is the end at the opposite end as the base end part 611, 621; and a middle part 613, 623 between the base end part 611, 621 and the distal end part 612, 622. The middle part 613, 623 curves from the base end part 611, 621 to the distal end part 612, 622 as with the timepiece bands 20, 30, and 40 in the second to fourth embodiments.

Multiple grooves 63 are formed in the surface of the first band 61 and second band 62 and across the width of the first band 61 and second band 62. The width of the first band 61 and second band 62 is the direction on the surface of the bands first band 61, 62 perpendicular to the lengthwise direction from the base end part 611, 621 to the distal end part 612, 622.

The grooves 63 are spaced substantially equally along the length of the first band 61 and second band 62. The grooves 63 enable the first band 61 and second band 62 to bend and curve easily.

Effect of Embodiment 6

The first band 61 and second band 62 of the timepiece band 60 are configured substantially the same as the timepiece band 30 in the third embodiment, and therefore have the same effect as in the third embodiment.

In addition, because grooves 63 are formed in the surface of the first band 61 and second band 62, the bands 61, 62 can curve easily. As a result, the fit and feel of the timepiece band 60 when worn on the wrist can be further improved.

Variation of Embodiment 6

Figure 12:
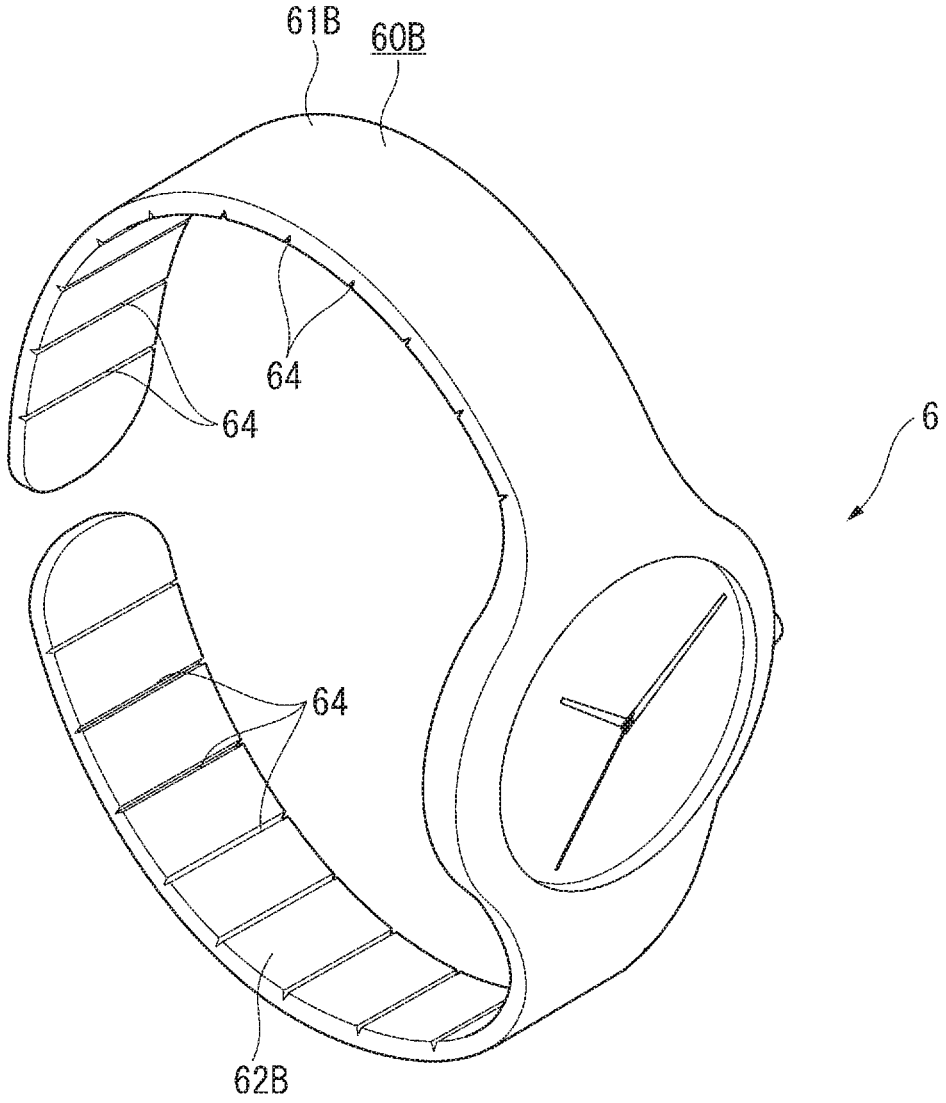
FIG. 12 is an oblique view of a timepiece according to variation of the sixth embodiment of the invention.

The timepiece band 60 described above has the grooves 63 formed in the outside surface of the first band 61 and second band 62, but as shown in the timepiece band 60B of the timepiece 6 shown in FIG. 12, the grooves 64 may be formed on the inside surface of the first band 61B and second band 62B. In addition, while not shown in the figures, grooves 63, 64 may be formed in both the outside and inside surfaces of the first band 61 and second band 62.

Embodiment 7

Figure 13:
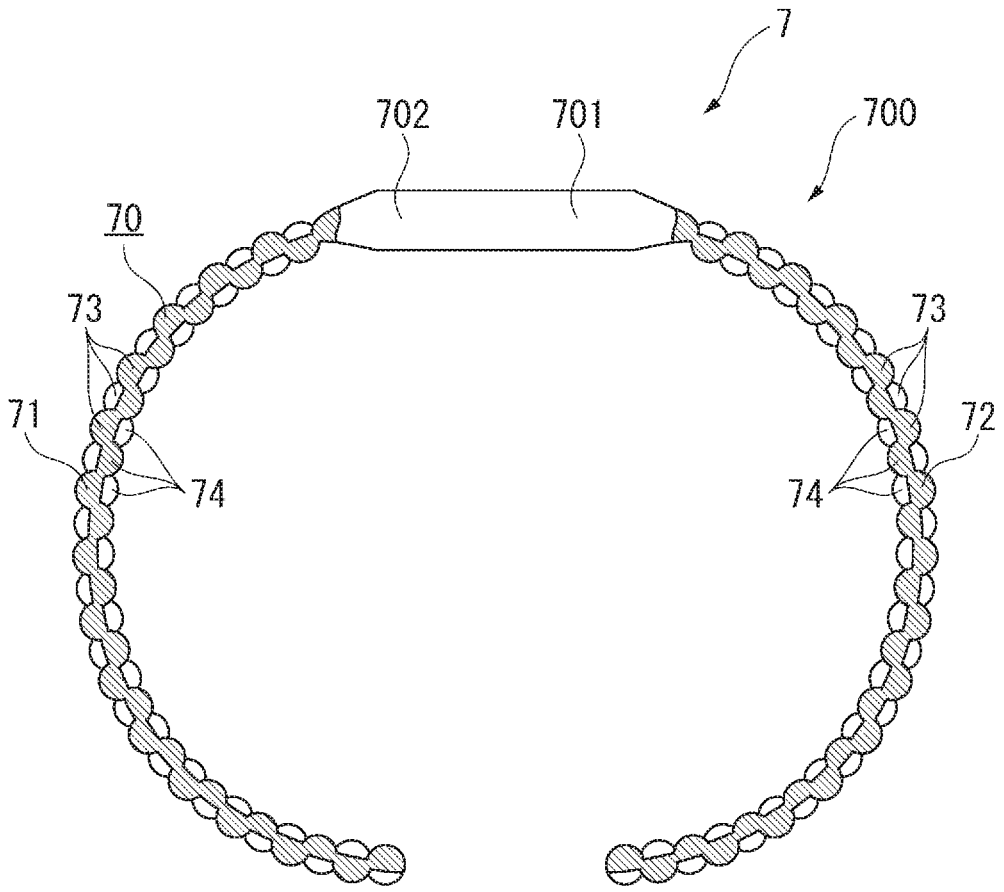
FIG. 13 is a section view of a timepiece according to the seventh embodiment of the invention.

A timepiece 7 according to the seventh embodiment of the invention is described next with reference to FIG. 13. The timepiece 7 has an external timepiece part 700 including an integrally molded timepiece case 701 and a timepiece band 70.

The external timepiece part 700 is configured as a single member made of metallic glass having an elastic modulus greater than or equal to 30 GPa and less than or equal to 70 GPa, and an elastic limit greater than or equal to 2% and less than or equal to 20%. Specific examples of the metallic glass are the same as described in the foregoing embodiments.

The timepiece case 701 in this example has a substantially round case body 702. In this embodiment the dial is formed separately from the case body 702, but the dial and case body 702 may be integrally molded.

In this embodiment the timepiece band 70 includes a first band 71 attached to the 12:00 side of the timepiece case 701, and a second band 72 attached to the 6:00 side of the timepiece case 701. The case body 702, first band 71, and second band 72 of the external timepiece part 700 are therefore formed as an integral molding of metallic glass.

Multiple semispherical protrusions 73, 74 are formed on the inside and outside surfaces of the first band 71 and second band 72. The protrusions 73, 74 on the inside and outside surfaces are formed at a specific pitch along the length and the width, which is perpendicular to the length, of the first band 71 and second band 72. The protrusions 73 on the outside surface, and the protrusions 74 on the inside surface, are offset one-half pitch along both the length and width.

Effect of Embodiment 7

Because multiple protrusions 73, 74 are formed on both the outside and inside surfaces of the first band 71 and second band 72 of the timepiece band 70 according to the seventh embodiment of the invention, the bands 71, 72 can bend easily while assuring the strength of the bands 71, 72. In addition, because semispherical protrusions 73, 74 are formed, the timepiece band 70 can be made a highly decorative timepiece band.

OTHER EMBODIMENTS

The invention is not limited to the embodiments described above, and can be modified and improved in many ways without departing from the scope of the accompanying claims.

Figure 14:
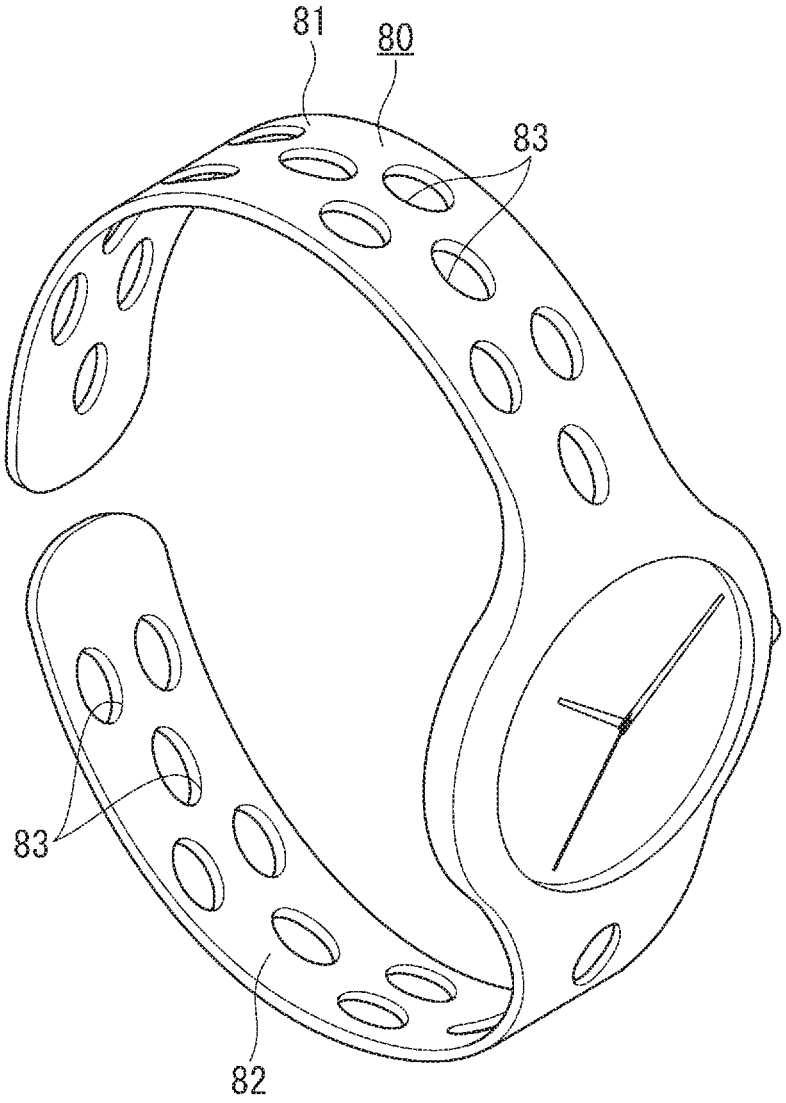
FIG. 14 is an oblique view of a timepiece according to variation of the invention.

The design of the timepiece band is not limited to the embodiments described above. For example, as shown in FIG. 14, multiple holes 83 may be formed in a metallic glass timepiece band 80 including a first band 81 and a second band 82. By using a mold with protrusions for forming holes, the holes 83 can be easily formed simultaneously to molding the first band 81 and second band 82.

Forming holes 83 in the timepiece band 80 can also reduce the weight of the timepiece band, and improve ventilation and the design.

Figure 15:
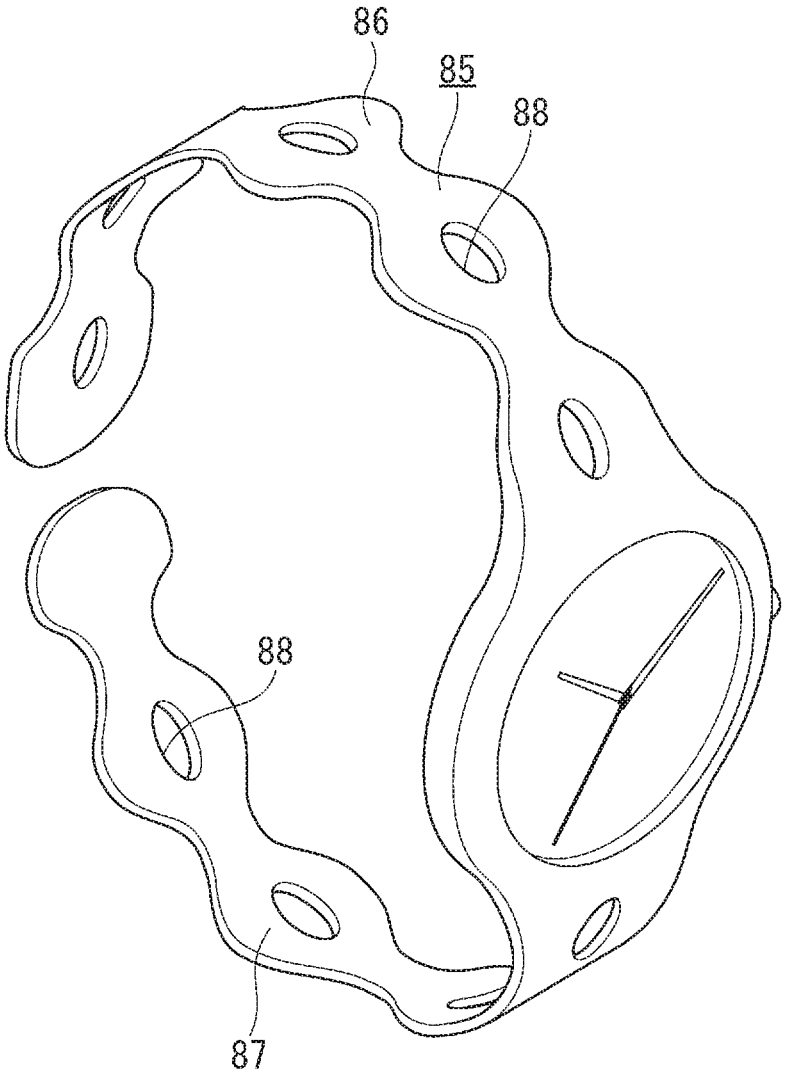
FIG. 15 is an oblique view of a timepiece according to variation of the invention.

As shown in FIG. 15, the first band 86 and second band 87 configuring another timepiece band 85 may be formed with the width of bands 86, 87 varying along the length of the bands 86, 87. Holes 88 may also be formed in the bands 86, 87.

By changing the width of the timepiece band 85 in this way, the weight of the timepiece band can be reduced, and ventilation and the design can be improved.

Figure 16:
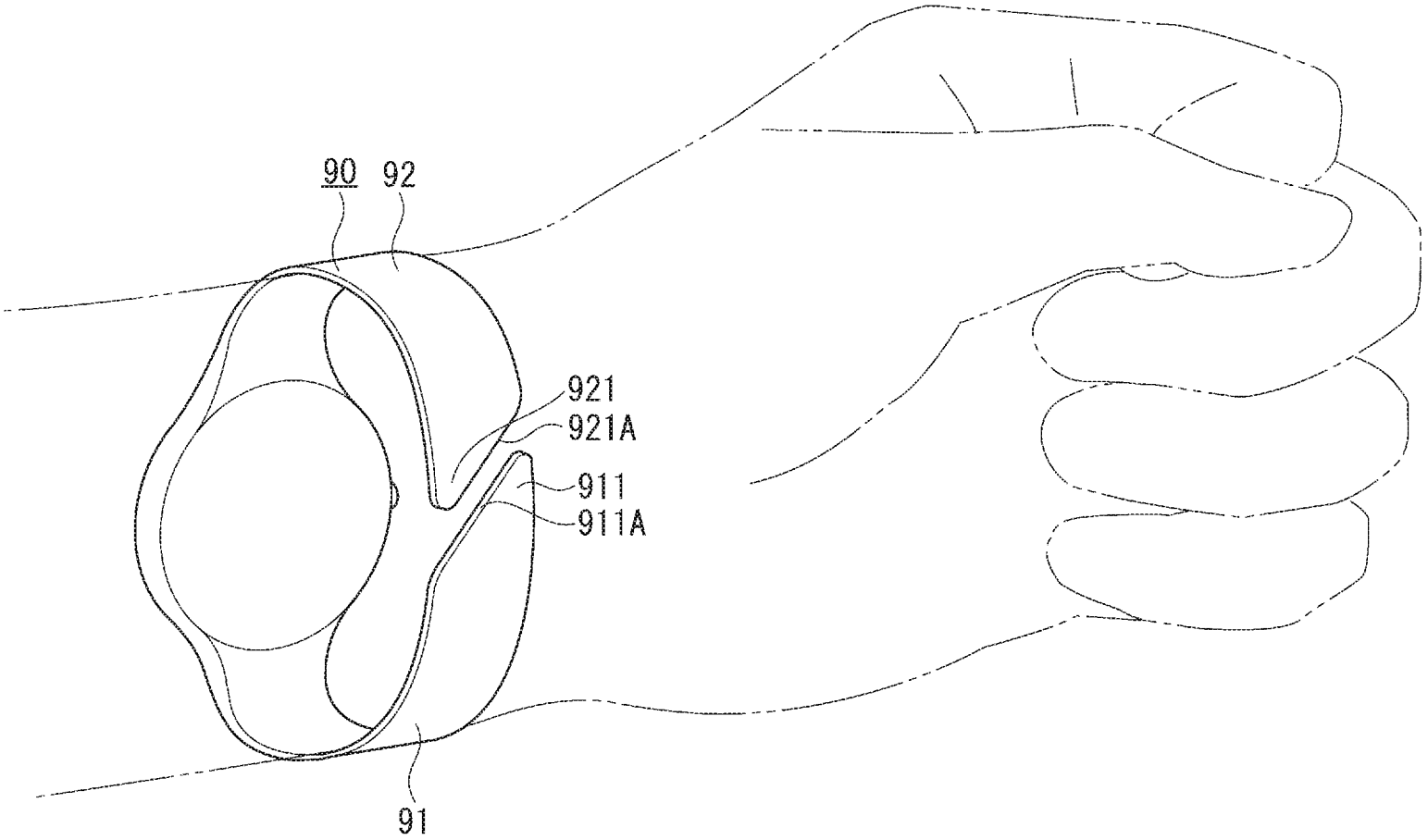
FIG. 16 is an oblique view of a timepiece according to a variation of the invention when worn on the wrist.

The shapes of the distal ends of the first band and second band are also not limited to the foregoing embodiments. For example, as shown by the timepiece band 90 in FIG. 16, the distal ends 911, 912 of the first band 91 and second band 92 may be shaped with the width decreasing to the distal end. In this case, the distal ends 911, 912 have angled faces 911A, 921A that slope lengthwise and widthwise to the first band 91 and second band 92, and the angled faces 911A, 921A are formed parallel and in opposition to prevent interference therebetween.

The distal ends 911, 921 of the bands 91, 92 can be formed to overlap lengthwise to the bands 91, 92 configuring the timepiece band 90. A timepiece band 90 configured this way can increase the area of contact with the wrist of the user, and improve the ability to hold the timepiece to the wrist.

Figure 17:
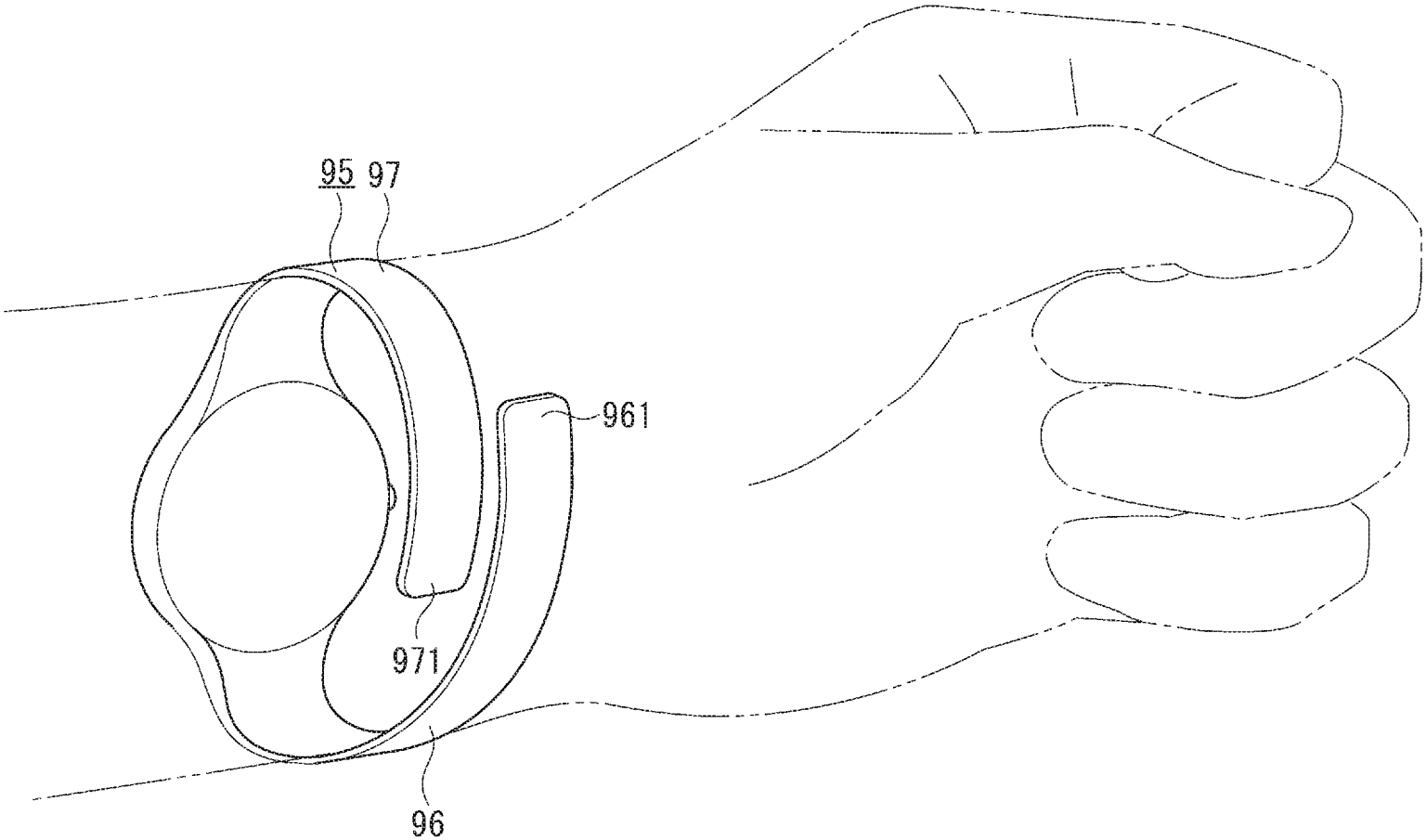
FIG. 17 is an oblique view of a timepiece according to a variation of the invention when worn on the wrist.

In a timepiece band 95 as shown in FIG. 17, the first band 96 and second band 97 form a spiral, and the locations of the distal ends 961, 971 of the bands 96, 97 are offset widthwise to the bands 96, 97.

Like the timepiece band 90 described above, this timepiece band 95 can improve the ability to hold the timepiece on the wrist by the distal ends 961, 971 overlapping lengthwise to the bands 96, 97.

In the timepiece 1 according to the first embodiment of the invention the first band 11 and second band 12 are formed separately from the timepiece case 101, but the timepiece case 101, first band 11, and second band 12 may be integrally molded from metallic glass. More specifically, the first band 11 and second band 12 formed integrally to the timepiece case 101 may be formed as straight bands that do not curve when not worn. In this case, the first band 11 and second band 12 can be curved and connected when worn on the wrist by providing a connector such as permanent magnets or a hook and holes to the bands.

Structures used for the timepiece bands when the timepiece case and timepiece bands are molded integrally as shown in FIG. 6 to FIG. 17 can also be used with the timepiece bands formed separately from the timepiece case as shown in FIG. 1 to FIG. 5. For example, the thickness of the distal ends 112, 122, 212, 222 of the timepiece bands 10, 20 according to the first and second embodiments may be increased similarly to timepiece band 50. In addition, grooves 63, 64 or protrusions 73, 74 may be formed on the face and back surfaces of the timepiece bands 10, 20. The timepiece bands 10, 20 may also be configured like timepiece bands 80, 85, 90, 95.

A single timepiece band that attaches to only the 12:00 or 6:00 position of the timepiece case similarly to the timepiece band 40 of the fourth embodiment may also be used as a timepiece band that is separate from the timepiece case.

In the embodiments described above the timepiece case and the back cover are separate parts, but a one-piece timepiece case with the timepiece case and back cover formed as an integral molding may also be used. By using a one-piece timepiece case, water resistance can be further improved, a ridge at the connection between the case body and the back cover can be eliminated, and the fit and feel when worn on the wrist can be improved.

Note that because the movement must be installed from the opening on the face side of the timepiece case when a one-piece timepiece case is used, the dial must be configured separately from the timepiece case.

The method of manufacturing the timepiece band and external timepiece part may be any manufacturing method suitable for metallic glass materials, and may be desirably adapted according to the structure of the manufactured product.

A timepiece using the timepiece band and external timepiece part described above may also have functions other than for displaying the time. For example, environmental sensors for measuring temperature, humidity, air pressure, UV exposure, and light may be provided to enable functions for displaying by analog hands or a digital display the results of measurements from the sensors.

Biological sensors for measuring the pulse rate, blood pressure, body temperature, or body movements of the user wearing the timepiece may also be provided, and functions for displaying by analog hands or a digital display the results of measurements from the sensors may be provided. The timepiece may also have functions for communicating with smartphones and other devices, and functions for displaying by analog hands or a digital display the communication state or communication content.

The timepiece may also have functions for communicating with smartphones and other devices, and functions for displaying by analog hands or a digital display the communication state or communication content.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece band comprising:

a first band made of metallic glass with an elastic modulus greater than or equal to 30 GPa and less than or equal to 70 GPa, and an elastic limit greater than or equal to 2% and less than or equal to 20%, and configured to connect to a timepiece case; and a second band made of metallic glass with an elastic modulus greater than or equal to 30 GPa and less than or equal to 70 GPa, and an elastic limit greater than or equal to 2% and less than or equal to 20%, and configured to connect to the timepiece case.

2. The timepiece band described in claim 1, wherein:

the first band and the second band each have a base end part that connects to the timepiece case, a distal end part that is an opposite end as the base end part, and a middle part between the base end part and the distal end part, the middle part curving from the base end part to the distal end part.

3. The timepiece band described in claim 2, wherein:

a thickness of the distal end part is greater than a thickness of the middle part.

4. The timepiece band described in claim 2, wherein:

the metallic glass is metallic glass based on Pt, Au, Ti, Mg, Pd, or Zr.

5. The timepiece band described in claim 2, wherein:

a hardness of the metallic glass is greater than or equal to 300 HV and less than or equal to 500 HV.

6. The timepiece band described in claim 1, wherein:

the first band and the second band each have a base end part attached to the timepiece case, a distal end part that is an opposite end as the base end part, and a middle part between the base end part and the distal end part, a thickness of the distal end part being greater than a thickness of the middle part.

7. The timepiece band described in claim 1, wherein:

the metallic glass is metallic glass based on Pt, Au, Ti, Mg, Pd, or Zr.

8. The timepiece band described in claim 7, wherein:

a hardness of the metallic glass is greater than or equal to 300 HV and less than or equal to 500 HV.

9. The timepiece band described in claim 1, wherein:

a hardness of the metallic glass is greater than or equal to 300 HV and less than or equal to 500 HV.

10. An external timepiece part comprising:

a timepiece case, first band, and second band integrally molded from metallic glass with an elastic modulus greater than or equal to 30 GPa and less than or equal to 70 GPa, and an elastic limit greater than or equal to 2% and less than or equal to 20%.

11. The external timepiece part described in claim 10, further comprising:

a connection device that connects the first band and the second band.

12. The external timepiece part described in claim 10, wherein:

the first band and the second band each have a base end part that is formed contiguously to the timepiece case, a distal end part that is an opposite end as the base end part, and a middle part between the base end part and the distal end part, the middle part curving from the base end part to the distal end part.

13. The external timepiece part described in claim 12, wherein:

a thickness of the distal end part is greater than a thickness of the middle part.

14. The external timepiece part described in claim 10, wherein:

the first band and the second band each have a base end part that is formed contiguously to the timepiece case, a distal end part that is an opposite end as the base end part, and a middle part between the base end part and the distal end part, a thickness of the distal end part being greater than a thickness of the middle part.

15. The external timepiece part described in claim 10, wherein:

the metallic glass is metallic glass based on Pt, Au, Ti, Mg, Pd, or Zr.

16. The external timepiece part described in claim 15, wherein:

a hardness of the metallic glass is greater than or equal to 300 HV and less than or equal to 500 HV.

17. The external timepiece part described in claim 10, wherein:

a hardness of the metallic glass is greater than or equal to 300 HV and less than or equal to 500 HV.

18. A timepiece comprising:

a timepiece case;

a first band made of metallic glass with an elastic modulus greater than or equal to 30 GPa and less than or equal to 70 GPa, and an elastic limit greater than or equal to 2% and less than or equal to 20%, and configured to connect to the timepiece case; and a second band made of metallic glass with an elastic modulus greater than or equal to 30 GPa and less than or equal to 70 GPa, and an elastic limit greater than or equal to 2% and less than or equal to 20%, and configured to connect to the timepiece case.

19. The timepiece described in claim 18, wherein:

the metallic glass is metallic glass based on Pt, Au, Ti, Mg, Pd, or Zr.

20. The timepiece described in claim 18, wherein:

a hardness of the metallic glass is greater than or equal to 300 HV and less than or equal to 500 HV.

* * * * *